US006230913B1

(12) United States Patent
Cornell et al.

(10) Patent No.: US 6,230,913 B1
(45) **Date of Patent: *May 15, 2001**

(54) STRAW IN A BOTTLE

(75) Inventors: Stephen W. Cornell, Naperville, IL (US); Peter F. Murphy, Grosse Pointe, MI (US)

(73) Assignee: The PopStraw Company, LLC, Roseville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/358,740

(22) Filed: Jul. 21, 1999

Related U.S. Application Data

(63) Continuation-in-part of application No. 09/016,847, filed on Jan. 30, 1998, now Pat. No. 6,142,326.

(51) Int. Cl.[7] ..... B65D 83/00

(52) U.S. Cl. ..... 215/387; 215/388; 215/40; 220/706; 239/33

(58) Field of Search ..... 239/33, 30, 24; 215/387, 388; 220/705, 706, 708, 709, 710; 426/85

(56) References Cited

U.S. PATENT DOCUMENTS

| | | | | |
|---|---|---|---|---|
| 942,306 | | 12/1909 | Clarke . | |
| 1,253,579 | | 1/1918 | Deanes . | |
| 1,309,994 | | 7/1919 | McAuliffe . | |
| 1,997,914 | | 4/1935 | Pollard . | |
| 2,150,439 | | 3/1939 | Hamilton . | |
| 2,260,968 | | 10/1941 | Cordis . | |
| 2,279,396 | | 4/1942 | Hanson, Jr. . | |
| 2,294,224 | * | 8/1942 | Daly | 215/387 |
| 2,613,988 | | 10/1952 | Jarbeau . | |
| 2,837,234 | | 6/1958 | Mainere . | |
| 2,997,195 | | 8/1961 | Yuen . | |
| 3,013,686 | | 12/1961 | Blunt . | |
| 3,099,565 | | 7/1963 | Neuhauser . | |
| 3,101,855 | | 8/1963 | Yuen . | |
| 3,211,379 | | 10/1965 | Burton . | |
| 3,220,587 | | 11/1965 | Griffin et al. . | |
| 3,291,331 | | 12/1966 | Grisham et al. . | |
| 3,326,695 | | 6/1967 | Neuhauser . | |
| 3,568,870 | | 3/1971 | Elston . | |
| 3,656,654 | * | 4/1972 | Brinkley | 220/708 |
| 3,746,197 | | 7/1973 | Sather . | |
| 3,776,458 | | 12/1973 | Chunga, Sr. . | |
| 4,194,674 | | 3/1980 | Pearson . | |
| 4,356,927 | * | 11/1982 | Cooper et al. | 220/708 |
| 4,379,511 | | 4/1983 | del Fabro . | |
| 4,448,316 | | 5/1984 | Hiroshige . | |
| 4,733,785 | | 3/1988 | Turner, Jr. et al. . | |
| 4,744,477 | | 5/1988 | Wofford . | |
| 4,792,083 | * | 12/1988 | Yassur | 220/708 |
| 4,877,148 | | 10/1989 | Larson et al. . | |
| 4,892,187 | | 1/1990 | Stein . | |
| 5,160,058 | | 11/1992 | Ahn . | |
| 5,431,297 | | 7/1995 | Rosello . | |
| 5,582,289 | | 12/1996 | Wright . | |
| 6,056,149 | * | 5/2000 | Murphy et al. | 220/705 |

* cited by examiner

*Primary Examiner*—Allan N. Shoap
*Assistant Examiner*—Tri M. Mai
(74) *Attorney, Agent, or Firm*—Harness, Dickey & Pierce, P.L.C.

(57) ABSTRACT

A container includes a body defining a chamber and a neck region. A straw is disposed within the chamber. The straw is inserted through the neck region and into the chamber prior to filling the chamber and is trapped or wedged between a first portion of the container and a second portion of the container by mechanical engagement with the container. The position of the straw within the chamber does not interfere with the filling of the container. When filling has been completed, the body of the container is manipulated to release the straw from its mechanical engagement with the container and position it within the neck region.

17 Claims, 7 Drawing Sheets

STRAW IN A BOTTLE

CROSS REFERENCE TO RELATED APPLICATIONS

This is a continuation-in-part of U.S. patent application Ser. No, 09/016,847, filed Jan. 30, 1998, now U.S. Pat. No. 6,142,326.

FIELD OF THE INVENTION

The present invention relates to container for beverages. More particularly, the present invention relates to beverage containers having a self-contained straw which automatically extends through the opening when the container is opened.

BACKGROUND OF THE INVENTION

Various designs have been proposed in the prior art for placing a straw within a beverage container that becomes accessible to the user when the beverage container is opened. Some of the prior art designs rely upon the user to manipulate the container after it has been opened to align the straw with the opening. Once aligned, the buoyancy of the straw and/or a float attached to the straw extend the straw through the opening. Still other prior art designs include a mechanism which has the ability to locate the straw within the container. The act of opening the container imparts a force and/or motion to the mechanism which then positions the straw in line with the opening. Again, buoyant forces acting on the straw extend the straw through the opening once it has been aligned.

While the prior art straw dispensing mechanisms remain technologically and commercially viable, the continued development of these systems has been directed to lowering the complexity and costs associated with these mechanisms while simultaneously maintaining and/or improving upon the reliability of these mechanisms.

SUMMARY OF THE INVENTION

The present invention provides the art with a unique dispensing mechanism which simplifies the way in which the straw is retained during the filling process while simultaneously ensuring that the straw will be available to the user upon opening the container.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
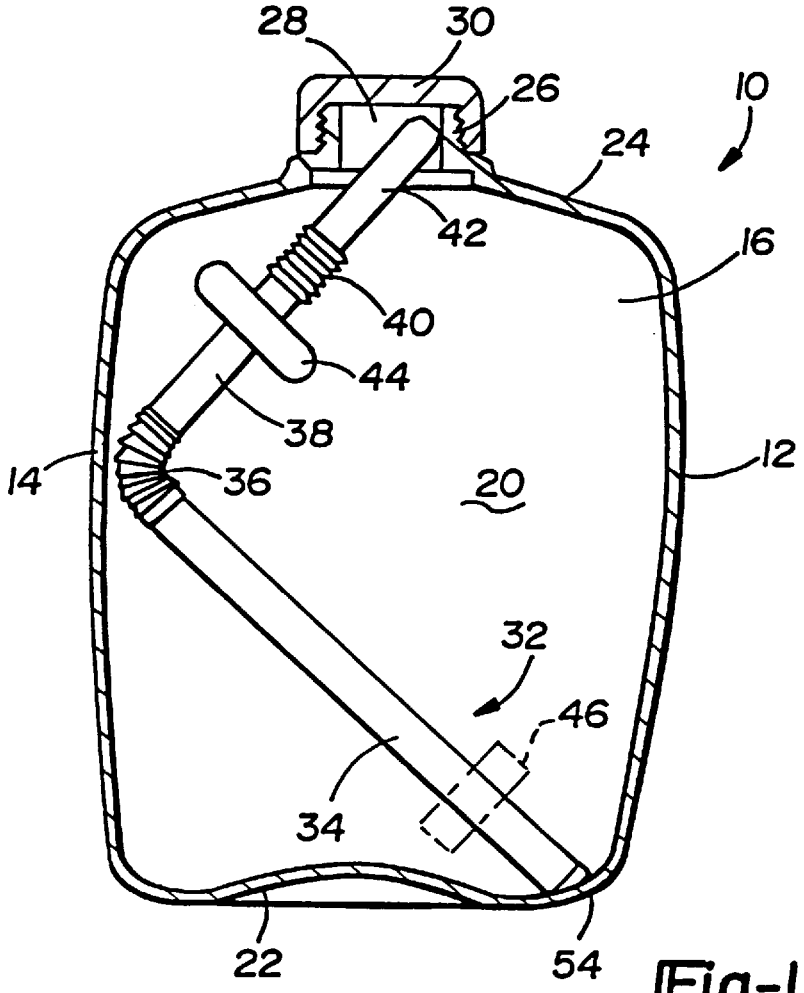
FIG. 1 is a cross sectional side view of a closed plastic bottle incorporating the straw and straw dispensing device in accordance with the present invention.

Referring now to the drawings in which like reference numerals designate like or corresponding parts throughout the several views, there is shown in FIG. 1 a beverage container incorporating an internal straw in accordance with the present invention which is designated generally by the reference numeral 10. Beverage container 10 is a generally rectangular parallelepiped container having a first pair of generally parallel side walls 12 and 14 and a second pair of generally parallel side walls 16 and 18. While container 10 is shown as a generally rectangular parallelepiped container, it is to be understood that container 10 could be manufactured in additional shapes including but not limited to cylindrical containers, square containers or the like. Walls 12, 14, 16 and 18 form a generally rectangular structure having an internal chamber 20 which is closed by a bottom wall 22 and a top wail 24. Container 10 may be manufactured by any of the conventional manufacturing techniques including but not limited to extrusion blow molding, reheat stretch blow molding or injection stretch blow molding. When being manufactured by extrusion blow molding, the preferable materials include polyolefins such as high density polyethylene (HDPE), polyethylene terephthalate (PET) or polyvinyl chloride (PVC). When either the reheat stretch blow molding or the injection stretch blow molding are being used to manufacture container 10, the preferred materials include PET or polypropylene (PP).

Top wall 24 includes a cylindrical extension 26 which defines a neck region 28 through which fluid that is stored in beverage container 10 can be dispensed. Neck region 28 is shown being closed and sealed by a threaded cap 30 but it is to be understood that neck region 28 can be closed and sealed by other means known in the art including but not limited to a snap cap closure or an induction bonded foil seal closure. Top wall 24 is shown being slightly angled towards neck region 28 to provide a cone of entry into neck region 28 from chamber 20.

A straw 32 is disposed within chamber 20 and, as shown in FIG. 1, is disposed adjacent to threaded cap 30. Straw 32 comprises a lower tubular section 34, a lower pleated section 36, a middle tubular section 38, an upper pleated section 40, an upper tubular section 42 and a float 44. Lower pleated section 36 provides the ability for straw 32 to bend and be preloaded within chamber 20. Upper pleated section 40 provides the ability for straw 32 to be extended for the convenience of the user. Float 44 is attached to middle tubular section 38 and provides buoyancy for straw 32 to urge it against threaded cap 30 after chamber 20 of container 10 has been filled with a fluid. If additional buoyancy is needed for straw 32, a second float 46 can be attached to straw 32 as shown in phantom in FIG. 1 where float 46 is attached to lower tubular section 34 of straw 32.

Figure 2:
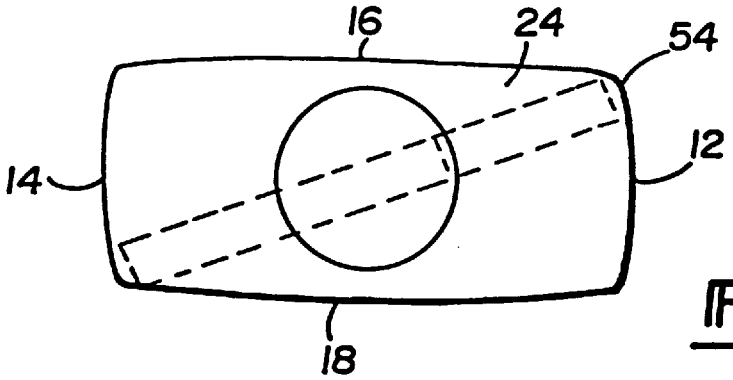
FIG. 2 is a top elevational view of the plastic bottle shown in FIG. 1.
Figure 3:
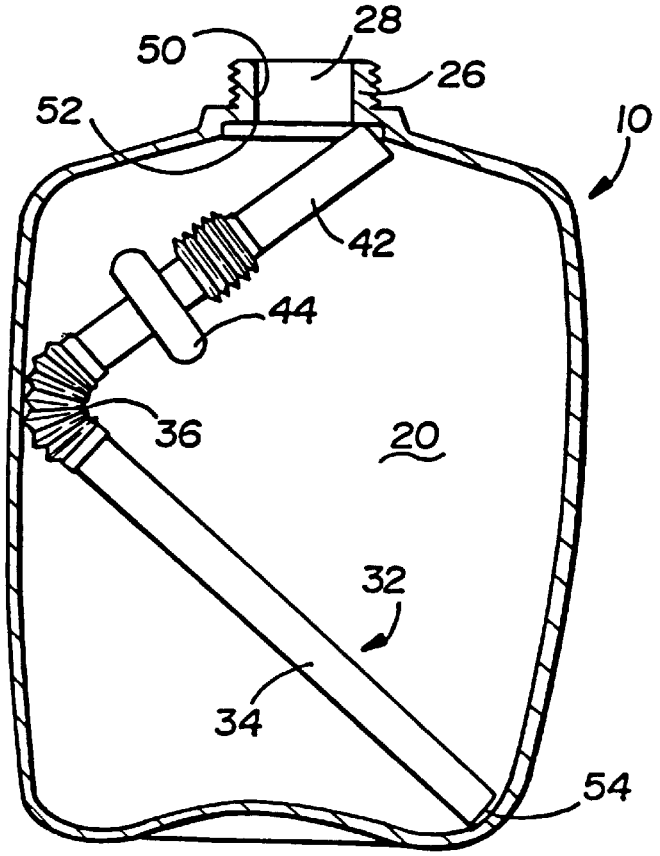
FIG. 3 is a cross sectional side view similar to FIG. 1 but showing the container and the straw dispensing device prior to the filling of the plastic bottle.

Referring now to FIG. 3, container 10 is shown prior to being filled with the fluid with straw 32 being located and retained within chamber 20. Neck region 28 is a stepped opening which defines a generally cylindrical wall 50 and an annular step 52. Prior to filling, straw 32, in a straight condition, is inserted into chamber 20 through neck region 28 until the end of lower tubular section 34 contacts a lower corner 54 of container 10. In order to secure straw 32 within chamber 20, lower corner 54 is preferably defined by one of the first parallel side walls 12 and 14, one of the second parallel side walls 16 and 18, and bottom wall 22 as shown in FIG. 2. When the end of lower tubular section 34 contacts corner 54, straw 32 flexes or bends at lower pleated section 36 and the upper end of upper tubular section 42 is snapped or wedged into annular step 52 to retain straw 32 within chamber 20 as shown in FIG. 3. Straw 32 is held against annular step 52 due to the elasticity of lower pleated section 36 which maintains the tendency to spring back towards a position where straw 32 is once again straight.

Once container 10 has been filled with the appropriate fluid and threaded cap 30 or another cap, is secured to extension 26 to seal neck region 28, walls 12, 14, 16 and/or 18 are squeezed or manipulated by suitable means in order to release the upper end of upper tubular section 42 from annular step 52 into the cone of entry and direct it into neck region 28. In the alternative, container 10 can be tilted or otherwise manipulated with or without the squeezing of one or more walls 12, 14, 16 and/or 18 to release the upper end of upper tubular section 42 from annular step 52. Once the upper end of upper tubular section 42 enters neck region 28 defined by cylindrical wall 50, the buoyancy of float 44 urges straw 32 against threaded cap 30 as shown in FIG. 1.

Figure 4:
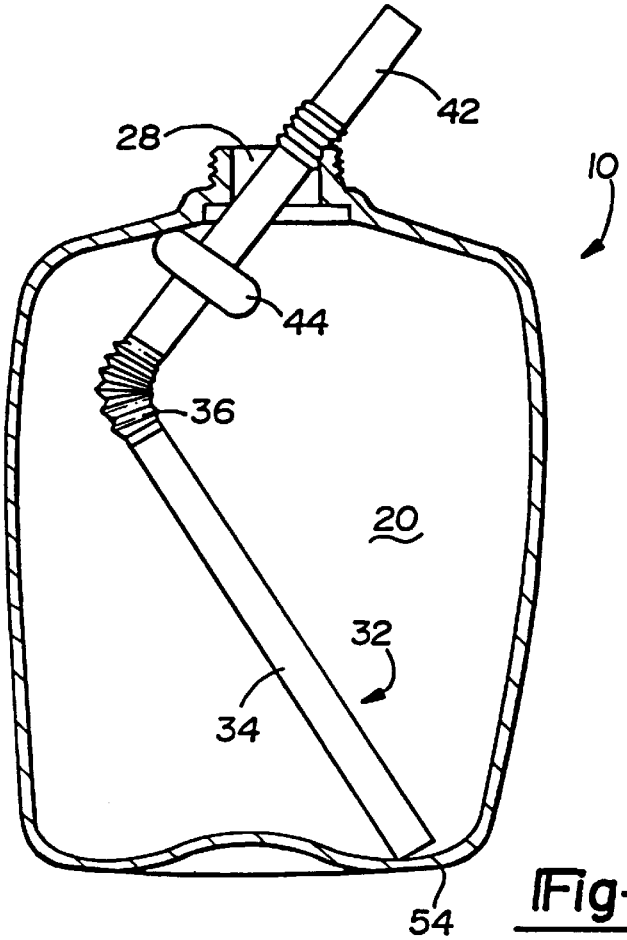
FIG. 4 is a cross sectional side view similar to FIG. 1 but showing the container and the straw dispensing device after the opening of the plastic bottle.

Referring now to FIG. 4, when threaded cap 30 is removed, straw 32 will rise through neck region 28 due to either the spring action of lower pleated section 36 which will have a tendency to straighten straw 32, the buoyancy of float 44 or both the spring action and the buoyancy. This movement of straw 32 through neck region 28 conveniently and automatically positions straw 32 for the convenience of the user. As shown in FIG. 3, the preflexed condition of straw 32 means that float 44 will propel straw 32 upwards such that upper tubular section 42 will traverse the cone of entry and neck region 28 obliquely and will not rise with the axis of the straw parallel with the axis of the bottle. Thus, straw 32 will remain generally in the position shown in FIG. 4 and will not have the tendency to bob up and down within neck region 28.

Figure 5:
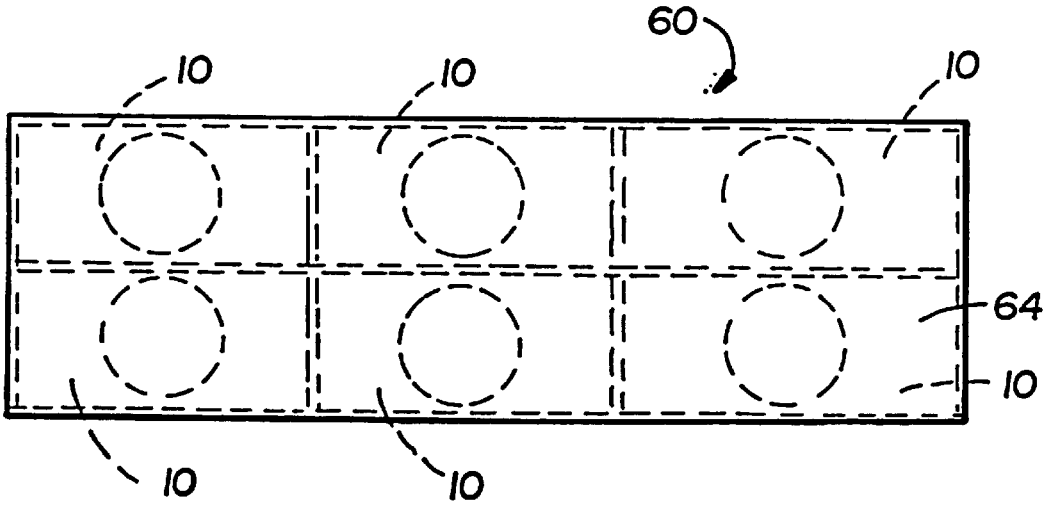
FIG. 5 is a top plan view of the multi-pack shown in FIG. 6.
Figure 6:
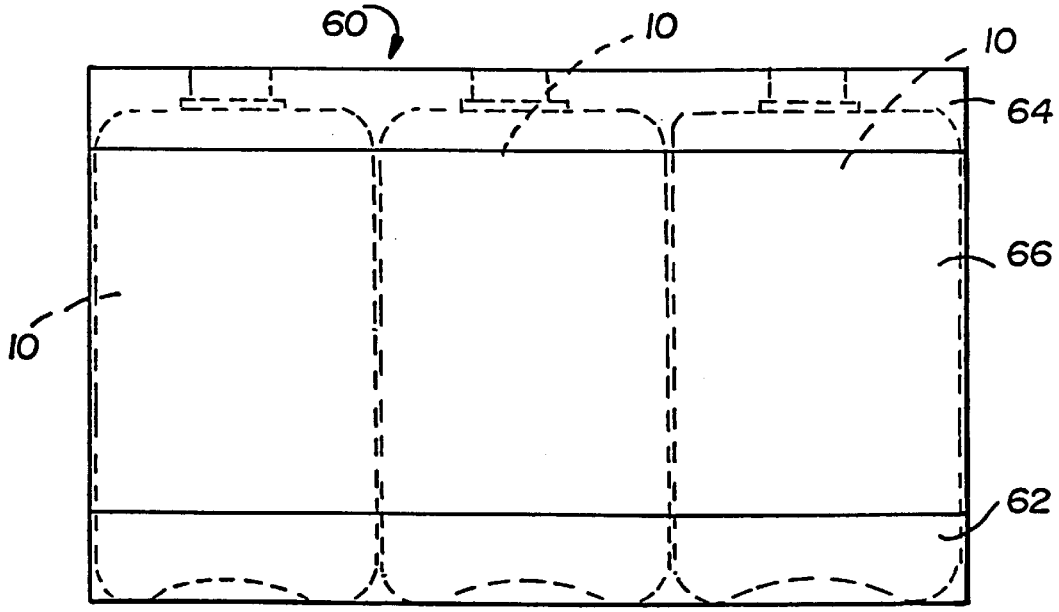
FIG. 6 is a side elevational view of a multi-pack of the beverage containers shown in FIG. 1.

FIGS. 5 and 6 illustrate the convenience provided by the generally rectangular parallelepiped shape of container 10 in supplying a multi-container pack 60 which comprises a lower carton tray bottom 62, an upper carton tray top 64 and a shrink wrap 66 or other retaining package for pack 60. Shrink wrap 66 also provides a convenient location for colorful labeling and/or advertising.

Figure 7:
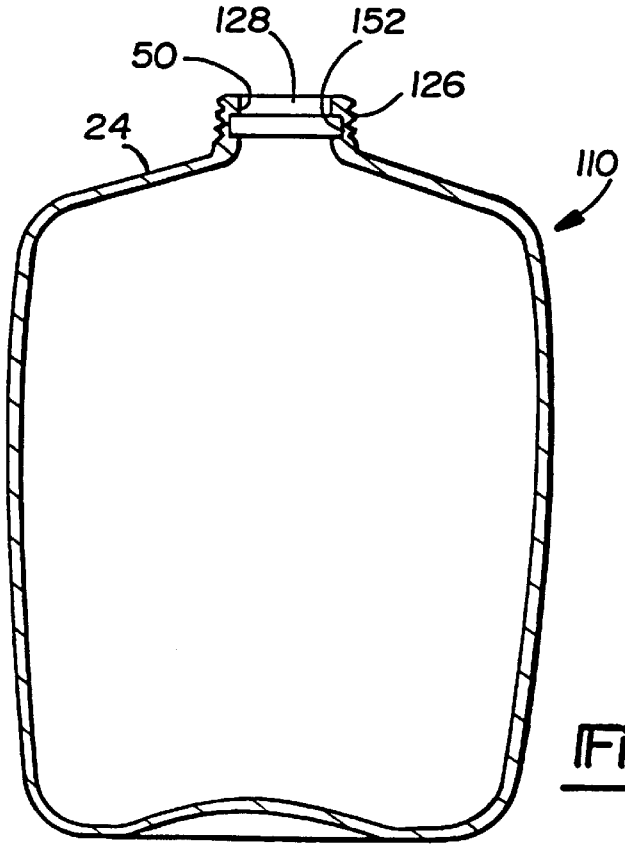
FIG. 7 is a side view of a plastic bottle in accordance with another embodiment of the present invention.

FIG. 7 illustrates a beverage container incorporating an internal straw in accordance with another embodiment of the present invention which is designated generally by the reference numeral 110. Beverage container 110 is the same as beverage container 10 with the exception that top wall 24 includes a cylindrical extension 126 which defines a neck region 128 through which fluid stored in beverage container can be dispensed. Neck region 128 is the same as neck region 28 except that generally cylindrical wall 50 defines an annular step 152 which is centrally located within wall 50 rather than being located adjacent the lower end of wall 50. The function and operation of container 110 is the same as that for container 10.

Figure 8:
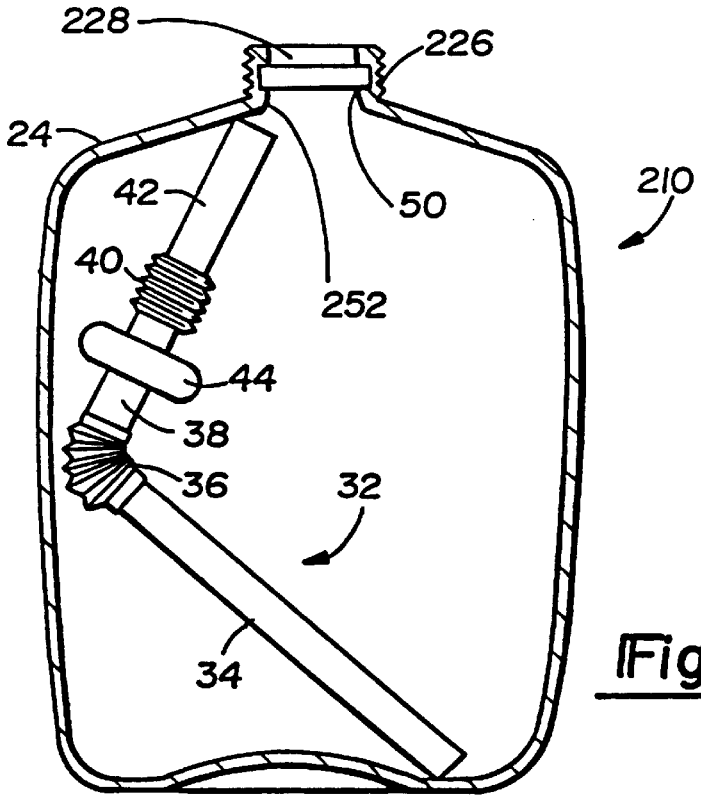
FIG. 8 is a side view of a plastic bottle in accordance with another embodiment of the present invention.

FIG. 8 illustrates a beverage container incorporating an internal straw in accordance with another embodiment of the present invention which is designated generally by the reference numeral 210. Beverage container 210 is the same as beverage container 10 with the exception that top wall 24 includes a cylindrical extension 226 which defines a neck region 228 through which fluid stored in beverage container can be dispensed. Neck region 228 is the same as neck region 28 except that generally cylindrical wall 50 defines an annular ridge 252 which is located at the lower end of wall. The function and operation of container 210 is the same as that for container 10. This embodiment provides the advantage that straw 32 will be located away from neck region 228 prior to container 210 being filled with a fluid. This position of straw 32 allows total access to neck region 228 without having to avoid straw 32 with the filling mechanism.

Figure 9:
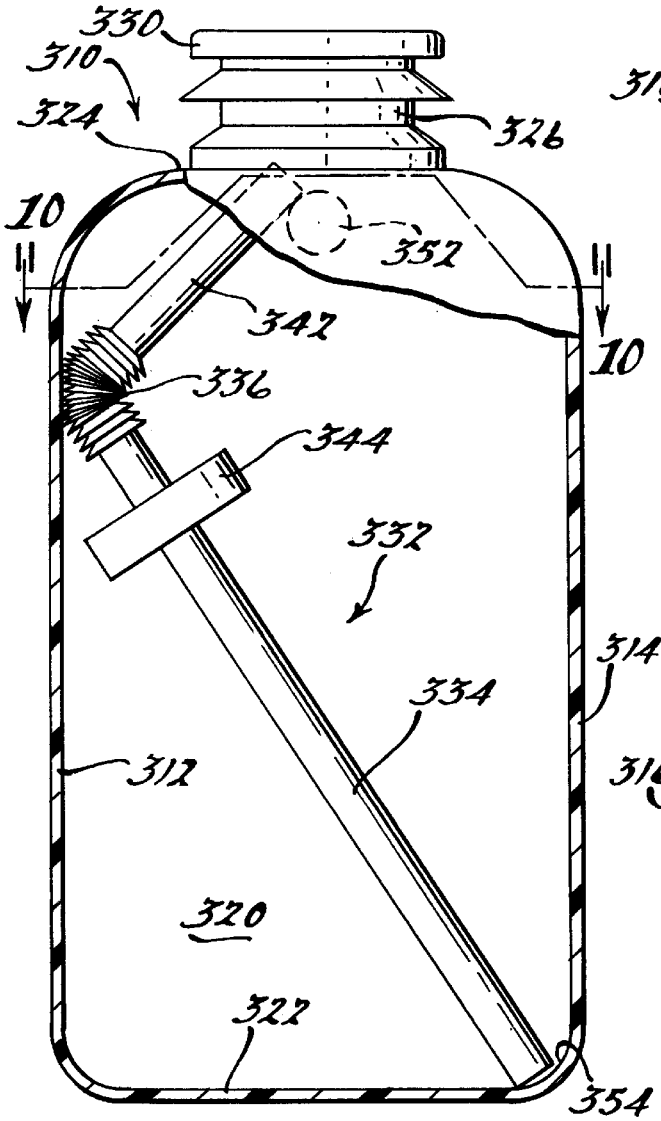
FIG. 9 is a side view of a plastic bottle in accordance with another embodiment of the present invention.
Figure 11:
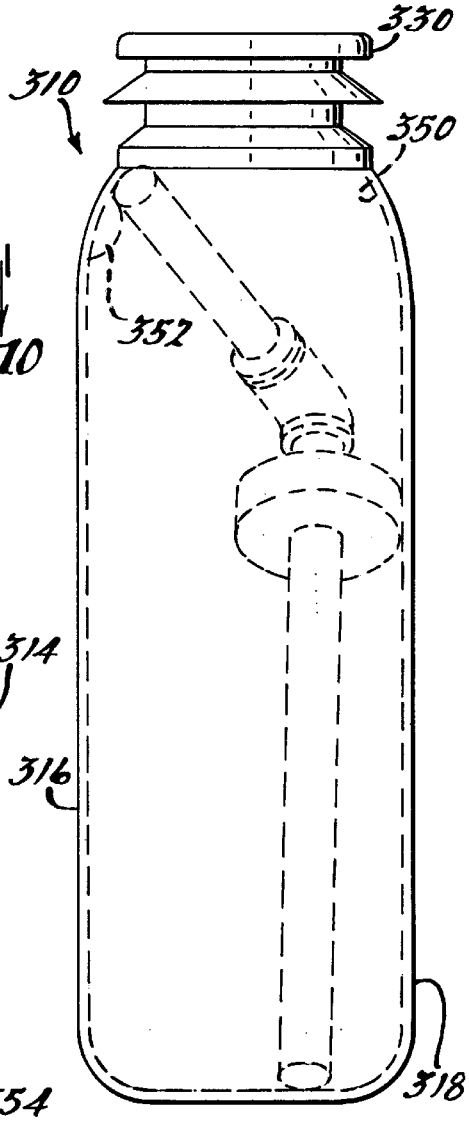
FIG. 11 is a top view of the plastic bottle shown in FIGS. 9 and 10.
Figure 10:
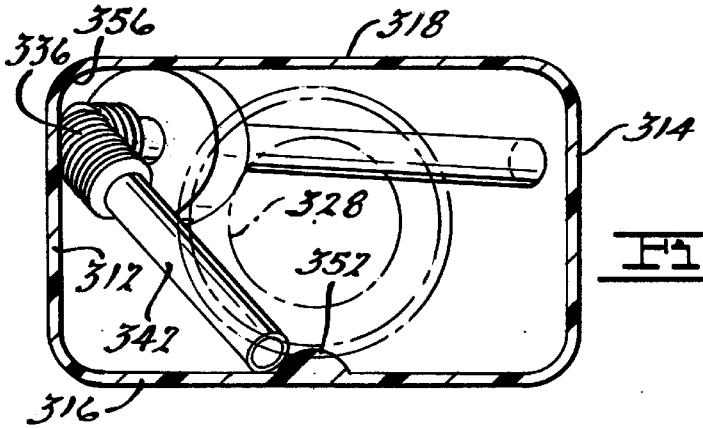
FIG. 10 is an end view of the plastic bottle shown in FIG. 9.

Referring now to FIGS. 9–11, a beverage container incorporating an internal straw in accordance with another embodiment of the invention is illustrated and indicated generally by the reference numeral 310. Beverage container 10 is a generally rectangular parallel piped container having a first pair of generally parallel side walls 312, 314 and a second pair of generally parallel side walls 316, 318. Walls 312, 314, 316 and 318 form a generally rectangular structure having an internal chamber 320 which is closed by a bottom wall 322 and a top wall 324. Container 310 may be manufactured by any of the conventional manufacturing techniques including but not limited to those mentioned above for container 10. When being manufactured by extrusion blow molding, the preferable materials include polyolefins such as HDPE, PET or PVC. When either the reheat stretch blow molding or the injection stretch molding are being used to manufacture container 310 the preferred materials include PET or PP.

Top wall 324 includes a cylindrical extension 326 which defines a neck region 328 through which fluid stored in beverage container 310 can be dispensed. Neck region 328 is shown being closed and sealed by a snap cap 330, but it is to be understood that neck region 328 can be closed and sealed by other means known in the art including but not limited to a threaded closure or an induction bonded foil seal closure. Top wall 324 is shown being angled slightly towards neck region 328 to provide a cone of entry into neck region 328 from chamber 320.

A straw 332 is disposed within chamber 320 and, as shown in FIGS. 9–11, is disposed in the position where filling of the container can be completed without straw 332 interfering with the process. Straw 332 comprises a lower tubular section 334, a pleated section 336, an upper tubular section 342 and a float 344. While not specifically illustrated, straw 332 could also include a second pleated section similar to pleated section 40 of straw 32 if desired. Pleated section 336 provides the ability for straw 332 to bend and be preloaded within chamber 320. The preferred bend angle for unloaded pleated section 336 ranges between 20 and 35 degrees. The preferred bend angle of loaded pleated section 336 ranges between 35 and 50 degrees and more preferably between 40 and 46 degrees. Float 344 is attached to lower tubular section 334 and provides a specific amount of buoyance for straw 332 to urge it against cap 330 when container 310 is closed and urge it out of neck region 328 when container 310 is opened.

The position of straw 332 in FIGS. 9–11 is shown prior to and after container 310 is filled with fluid and sealed. Neck region 328 is a stepped opening which is smaller than the width of container 310 to define a shoulder 350. Side wall 316 defines holding means in the form of a dimple 352 which aids in the retention of straw 332. Prior to filling, straw 332, in a generally straight condition, is inserted into chamber 320 through neck region 328 until the end of lower tubular section 334 contacts a lower corner 354 of container 310. When the end of lower tubular section 334 contacts corner 354, straw 332 flexes or bends at pleated section 336 and the upper end of upper tubular section 342 is snapped or wedged between shoulder 350 and dimple 352 to retain straw 332 within chamber 320. Straw 332 extends from corner 354 upward and generally parallel to the longer sides 316 and 318 such that pleated section 336 contacts a corner 356. Upper tubular section 342 extends from corner 356 across the width of container 310 defined by walls 312 and 314 to the position between shoulder 350 and dimple 352. Straw 332 is held in this position due to the elasticity of pleated section 336 which maintains the tendency to spring back towards a position where straw 332 is once again straight.

Once container 310 has been filled and cap 330 is secured to extension 326, walls 312, 314, 316 and/or 318 are squeezed or manipulated by suitable means to release the upper end of upper tubular section 342 from shoulder 350 and dimple 352 to position straw 332 similar to that shown in FIG. 1 for straw 32. When cap 330 is removed, straw 332 will rise through neck region 328 due to either the spring action of pleated section 336, the buoyancy of float 344 or both. This movement of straw 332 through neck region 328 positions straw 332 similar to that shown in FIG. 4 for straw 32.

Figure 12:
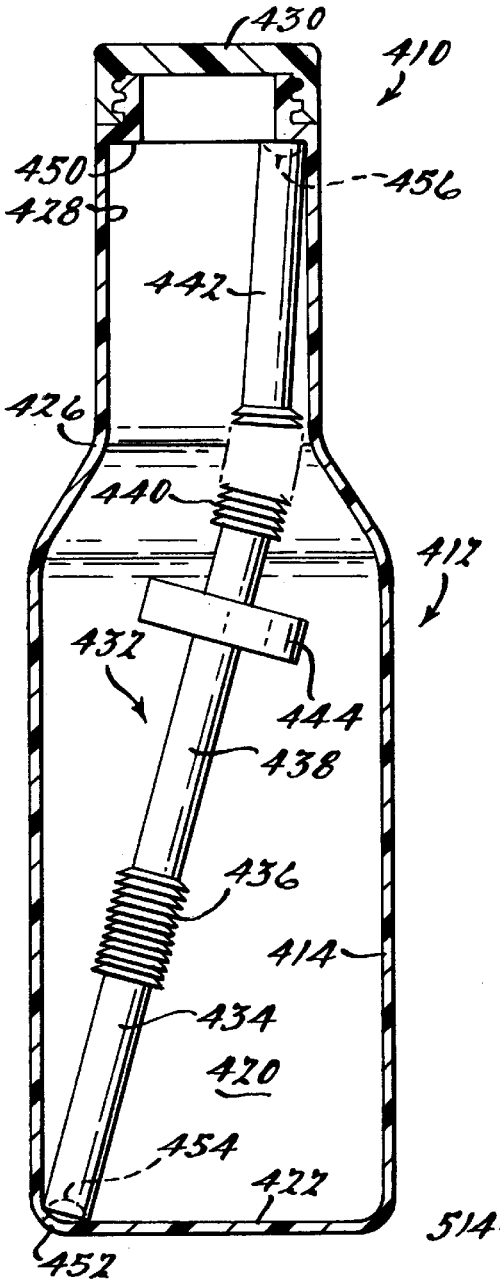
FIG. 12 is a side view of a bottle in accordance with another embodiment of the present invention.

Referring now to FIG. 12, a beverage container incorporating an internal straw in accordance with another embodiment of the present invention is illustrated and designated generally by the reference numeral 410. Beverage container 410 is a generally cylindrical container having a cylindrical wall 412 which defines a chamber 420. Container 410 can be manufactured from the various plastics mentioned above, it can be manufactured from glass, or it can be manufactured from other materials known in the art. While beverage container 410 is shown as a generally cylindrical container, it is to be understood that the present invention can be incorporated into either container shapes including but not limited to oval, rectangular or square.

Cylindrical wall 412 includes a lower cylindrical wall 414 which is closed by a bottom wall 422 and an upper cylindrical wall 426 which defines a reduced diameter neck region 428. Container 410 is filled through neck region 428 and the fluid is subsequently dispensed through neck region 428. Neck region 428 is shown being closed and sealed by a threaded 430 but it is to be understood that neck region 428 can be closed and sealed by other means known in the art including but not limited to a snap closure or an induction bonded foil seal closure.

A straw 432 is disposed within chamber 420. Straw 432 comprises a lower tubular section 434, a lower pleated section 436, a middle tubular section 438, an upper pleated section 440, an upper tubular section 442 and a float 444. Lower pleated section 436 is an extension pleat which provides the ability for the straw to be extended in length for the convenience of the user. Upper pleated section 440 is a preload flex pleat whose function is to bend and be preloaded within chamber 420. Pleated section 440 provides an angle between lower tubular section 432 and upper tubular section 442 when the pleat is extended. This angle ensures the ability to load straw 432 into container 410. The preferred angle of unloaded pleated section 440 ranges between 20 and 35 degrees. The preferred angle of loaded pleated section 440 ranges between 35 and 50 degrees and more preferably between 40 and 46 degrees. Float 444 is attached to middle tubular section 438 and provides buoyancy for straw 432 to extend straw 432 through the open end of neck region 428 when cap 430 is removed.

The position of straw 432 in FIG. 12 is shown prior to and after container 410 is filled with fluid and sealed by cap 430. Neck region 428 defines a shoulder 450 which is equal to or slightly smaller than the diameter of straw 432. This size of shoulder 450 allows straw 432 to be inserted within chamber 420 and positioned such that it does not interfere with the filling of container 410. Lower tubular section 434 rests against a corner 452 of container 410 with upper pleated section 440 providing the preload to keep straw 432 in position. If necessary, holding mans in the form of a dimple 454 can be added to corner 452 and/or holding means in the form of a dimple 456 can be added to shoulder 450.

Prior to filling, straw 632, in a generally straight condition, is inserted into chamber 420 through neck region 428 until the end of lower tubular section 434 contacts comer 452 and/or dimple 454. Initially, upper pleated section 440 is angled such that the end of lower tubular section 434 contacts bottom wall 422 and is deflected towards corner 452. When the end of lower tubular section 434 contacts corner 452 and/or dimple 454, straw 432 bends or flexes at upper pleated section 440 and the upper end of upper tubular section 442 is snapped or wedged against shoulder 450 and/or dimple 456 to retain straw 432 within chamber 420.

Once container 410 has been filled and cap 430 is secured to upper cylindrical wall 426, neck region 428 can be squeezed or manipulated by suitable means to release the upper end of upper tubular section 442 from shoulder 450 and/or dimple 456 to position straw 432 similar to that shown in FIG. 1 for straw 32. If container 410 is manufactured from a rigid material such as glass, manipulation of the entire container 410 will be needed to release straw 432.

When cap 430 is removed, straw 432 will rise through neck region 428 due to the buoyancy of float 444, the spring action of upper pleated section 440 or both. This movement of straw 432 through neck region 428 positions straw 432 similar to that shown in FIG. 4 for straw 32.

Figure 13:
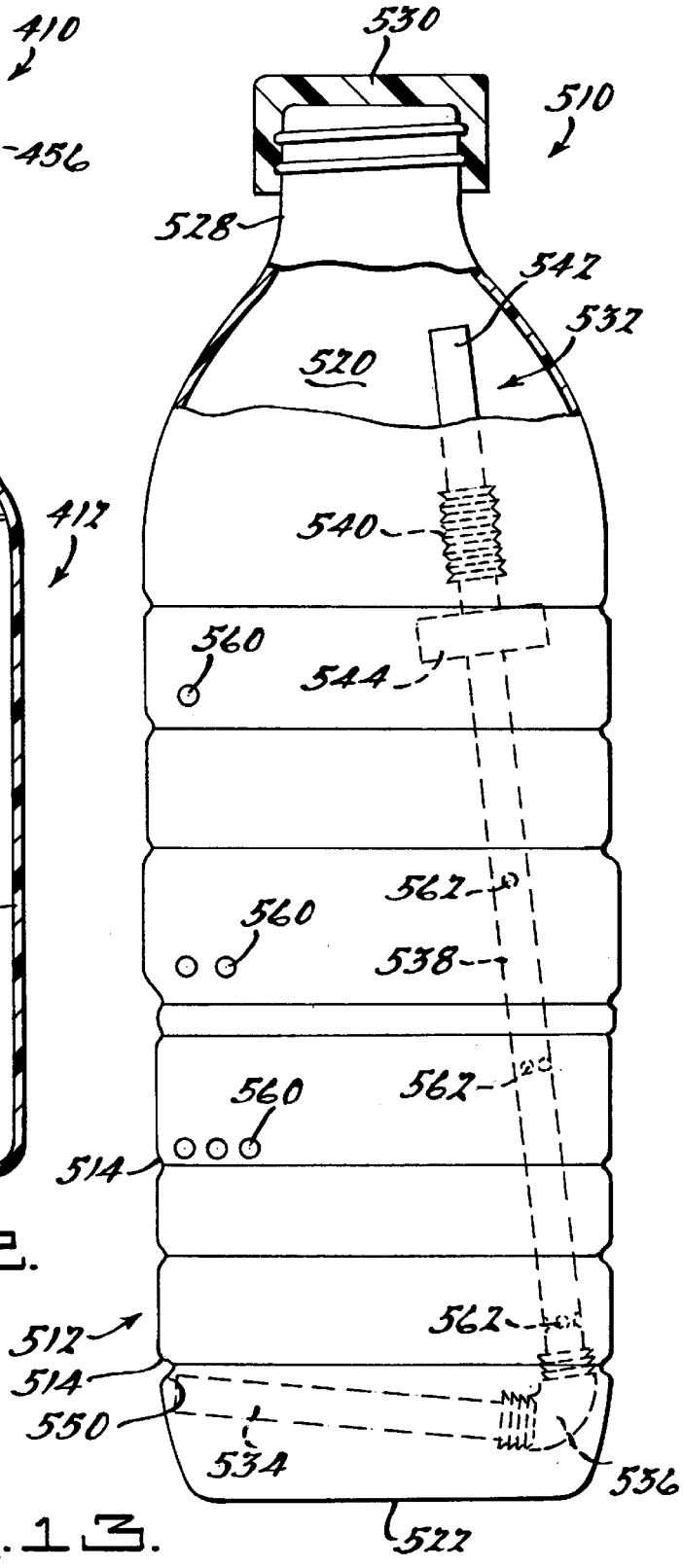
FIG. 13 is a side view of a bottle in accordance with another embodiment of the present invention.

Referring now to FIG. 13, a beverage container incorporating an internal straw in accordance with another embodiment of the present invention is illustrated and designated generally by the reference numeral 510. Beverage container 510 is a generally cylindrical container having a cylindrical wall 512 which defines a chamber 520. Container 510 can be manufactured from the various materials mentioned above for containers 10, 110, 210, 310 and 410. While container 510 is shown as a generally cylindrical container, it is to be understood that the present invention can be incorporated into other shapes of containers including but not limited to oval, rectangular or square.

Cylindrical wall 512 defines a plurality of annular grooves 514 which are formed into wall 512. A bottom wall 522 closes the lower end of wall 512 and a reduced diameter neck region 528 is formed into the upper end of wall 512. Cylindrical wall 512 is shown being angled towards neck region 528 from chamber 520. Container 510 is filled through neck region 528 and the fluid is subsequently dispensed through neck region 528. Neck region 528 is shown being closed and sealed by a threaded cap 530 but it is to be understood that neck region 528 can be closed and sealed by other means know in the art including but not limited to a snap closure or an induction bonded foil seal closure.

A straw 532 is disposed within chamber 520. Straw 532 comprises a lower tubular section 534, a lower pleated section 536, a middle tubular section 538, an upper pleated section 540, an upper tubular section 542 and a float 544. Lower pleated section 536 is a preload flex pleat whose function is to bend and be preloaded within chamber 520. Lower pleated section 536 provides an angle between lower tubular section 534 and middle tubular section 538 when the pleat is extended. This angle ensures the ability to load straw 532 into container 510. The preferred angle between lower tubular section 532 and middle tubular section 538 is between 105 and 118 degrees. Upper pleated section 540 is an extension pleat which provides the ability for the straw to be extended in length for the convenience of the user. Float 544 is attached to middle tubular section 538 and provides buoyancy for straw 532 to extend straw 532 through the open end of neck region 528 when cap 530 is removed.

The position of straw 532 in FIG. 13 is shown prior to and after container 510 is filled with fluid and sealed by cap 530. The lower groove 514 defines a shoulder 550 which is utilized to retain straw 532 during the filling process. The length of lower tubular section 534 is designated to extend across the diameter of chamber 520 such that lower pleated section 536 nests below the lower groove 514 to retain straw 532. The free end of lower tubular section 534 rests against the internal surface of cylindrical wall 512. Lower pleated section 536 rests against the diametrically opposite internal surface of cylindrical wall 512 and bends around the lower groove 514 such that the remaining portions of straw 532 extend upwards towards neck region 528. The combined length of middle tubular section 538, upper pleated section 540 and upper tubular section 542 are designed such that the free end of upper tubular section 542 is located within the portion of cylindrical wall 512 which is angled towards neck region 528. In this manner, straw 532 is positioned such that is does not interfere with the filling process of container 510.

Prior to filling, straw 532, in a generally straight condition, is inserted into chamber 520 through neck region 528 until the end of lower tubular section 534 contacts the inner surface of cylindrical wall 512. Initially, lower pleated section 536 will be angled such that the end of lower tubular section 534 contacts bottom wall 522 and is deflected towards cylindrical wall 512. The insertion of straw 532 continues until lower pleated section 536 snaps or wedges below shoulder 550 defined by the lower annular groove 514 to retain straw 532 within chamber 520.

Once container 510 has been filled and cap 530 is secured to neck region 528, cylindrical wall 512 is squeezed or manipulated by suitable means to release lower pleats 536 from shoulder 550 to position straw 532 similar to that shown in FIG. 1 for straw 32.

When cap 530 is removed, straw 532 will rise through neck region 528 due to the buoyancy of float 544, the spring action of upper pleated section 536 or both. The movement of straw 532 through neck region 528 positions straw 532 similar to that shown in FIG. 4 for straw 32.

In any of the above described embodiments, the rate of rise of the straw is controlled by the ability of the float to lift the weight of the device which will ultimately reside above the liquid level and above the float as well as to overcome drag and viscous forces which will retard the rate of rise of the device.

It is well known to those skilled in the art that buoyancy in the float and the buoyancy of the straw produces the lift to raise this weight above the fluid level in the container. Initially, one may presume that the amount of buoyancy required to lift this weight is only somewhat greater than the weight or the object to be lifted.

The inventors of the present invention have determined that to adequately raise the weight at a rate which is acceptable, the range for lift buoyancy which produces an acceptable rate of rise is between two and six times the weight which is to be lifted. Preferably, this range is between three and five times the weight to be lifted and more preferably this range is between four and five times the weight to be lifted. It has been found that a buoyancy of one to two times the weight to be lifted will raise the device but at a speed rate on which is too slow to be effective.

The desired rate of rise for the device is in the range of 0.2 to 3.0 inches per second. Preferably, this range is between 1.0 and 2.5 inches per second and more preferably this range is between 1.5 to 2.0 inches per second. These ranges are achieved by having the lift buoyancy to weight ratios indicated above.

Another feature of the present invention is illustrated in FIG. 13. Beverages are being supplied in larger sized bottles and the size of these bottles means that the beverage will be consumed at multiple times with the bottle being sealed and stored in between times of consumption. Straw 532 is designed to present itself to the consumer when cap 530 has been removed. To do this, float 544 urges straw 532 through neck region 528. Float 544 is able to urge straw 532 upward because it is initially located below the surface level of a full container 510. When a portion of the liquid within container 510 is consumed and the consumer wishes to store container 510, the consumer pushes straw 532 into container 510 and reveals neck region 528 with cap 530. At this time, it is likely that float 544 will not be located below the surface level of the liquid remaining in container 510. Thus, when cap 530 is again removed, straw 532 will not present itself to the consumer because float 544 does not have a buoyant force since it is sitting in air, not liquid.

Container 510 provides a solution to the above problem by locating a plurality of indicia or dimples 560 on wall 512 at various heights along wall 512. Straw 532 is also provided with a plurality of indicia or dimples 562 at various heights along the length of straw 532. Each indicia or dimple 560 on wall 512 in unique and corresponds to a unique indicia or dimple 562 on straw 532. AS shown in FIG. 13, indicia 560 and 562 are shown as a single mark, a double mark and a triple mark. It is to be understood that any unique indicia or marking can be used. Thus, when the fluid level in the bottle is at the first indicia or dimple, the consumer, before pushing straw 530 into container 510, relocates float 544 at the first indicia or dimple on straw 532. This new location of float 544 will ensure that float 544 will be submerged in liquid and thus will have the buoyancy force needed to present straw 532 to the consumer during subsequent openings of cap 530. The same process is involved when the fluid level in container 510 is at the second level and when it is at the third level with float 544 being located at the second level and the third level, respectively.

While this fluid level/float matching concept has been described using container 510 and straw 532 shown in FIG. 13, it is to be understood that this concept can be incorporated into any of the embodiments described above.

Figure 14:
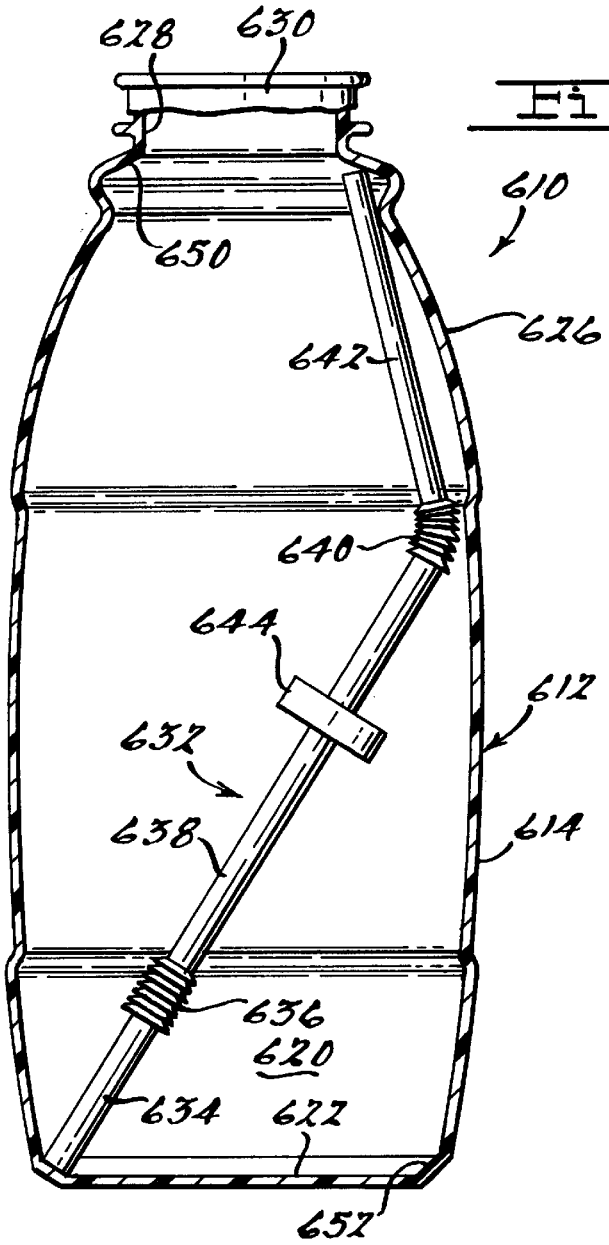
FIG. 14 is a side view of a bottle in accordance with another embodiment of the present invention.

Referring now to FIG. 14, a beverage container incorporating an internal straw in accordance with another embodiment of the present invention is illustrated and designated generally by the reference numeral 610. Beverage container 610 is a generally cylindrical container having a cylindrical wall 612 which defines a chamber 620. Container 610 can be manufactured from the various plastics mentioned above, it can be manufactured from glass, or it can be manufactured from other materials known in the art. While beverage container 610 is shown as a generally cylindrical container, it is to be understood that the present invention can be incorporated into either container shapes including but not limited to oval, rectangular or square.

Cylindrical wall 612 includes a lower cylindrical wall 614 which is closed by a bottom wall 622, an upper tapered wall 626 and a reduced diameter neck region 628. Container 610 is filled through neck region 628 and the fluid is subsequently dispensed through neck region 628. Neck region 628 is shown being closed and sealed by a snap fit 630 but it is to be understood that neck region 628 can be closed and sealed by other means known in the art including but not limited to a threaded closure or an induction bonded foil seal closure.

A straw 632 is disposed within chamber 620. Straw 632 comprises a lower tubular section 634, a lower pleated section 636, a middle tubular section 638, an upper pleated section 640, an upper tubular section 642 and a float 644. Lower pleated section 636 is an extension pleat which provides the ability for the straw to be extended in length for the convenience of the user. Upper pleated section 640 is a preload flex pleat whose function is to bend and be preloaded within chamber 620. Pleated section 640 provides an angle between lower tubular section 632 and upper tubular section 642 when the pleat is extended. This angle ensures the ability to load straw 632 into container 610. The preferred angle of unloaded pleated section 640 ranges between 20 and 35 degrees. The preferred angle of loaded pleated section 640 ranges between 35 and 50 degrees and more preferably between 40 and 46 degrees. Float 644 is attached to middle tubular section 638 and provides buoyancy for straw 632 to extend straw 632 through the open end of neck region 628 when cap 630 is removed.

The position of straw 632 in FIG. 14 is shown prior to and after container 610 is filled with fluid and sealed by cap 630. Tapered wall 626 defines an enlarged diameter annular section which forms shoulder 650 which is equal to or slightly smaller than the diameter of straw 632. This size of shoulder 650 allows straw 632 to be inserted within chamber 620 and positioned such that it does not interfere with the filling of container 610. Lower tubular section 634 rests against a contoured corner 652 of container 610 with upper pleated section 640 providing the preload to keep straw 632 in position. Contoured corner 652 is designed to mate with an retain lower tubular section 634 in position. If necessary dimples 454 and 456 in FIG. 12 can be added as holding means.

Prior to filling, straw 632, in a generally straight condition, is inserted into chamber 620 through neck region 628 until the end of lower tubular section 634 contacts contoured corner 652. Initially, upper pleated section 640 is angled such that the end of lower tubular section 634 contacts bottom wall 622 and is deflected towards contoured corner 652. When the end of lower tubular section 634 contacts corner 652, straw 632 bends or flexes at upper pleated section 640 and the upper end of upper tubular section 642 is snapped or wedged against shoulder 650 to retain straw 632 within chamber 620.

Once container 610 has been filled and cap 630 is secured to upper cylindrical wall 626, neck region 628 can be squeezed or manipulated by suitable means to release the upper end of upper tubular section 642 from shoulder 650 to position straw 632 similar to that shown in FIG. 1 for straw 32. If container 610 is manufactured from a rigid material such as glass, manipulation of the entire container 610 will be needed to release straw 632.

When cap 630 is removed, straw 632 will rise through neck region 628 due to the buoyancy of float 644, the spring action of upper pleated section 640 or both. This movement of straw 632 through neck region 628 positions straw 632 similar to that shown in FIG. 4 for straw 32.

Figure 15:
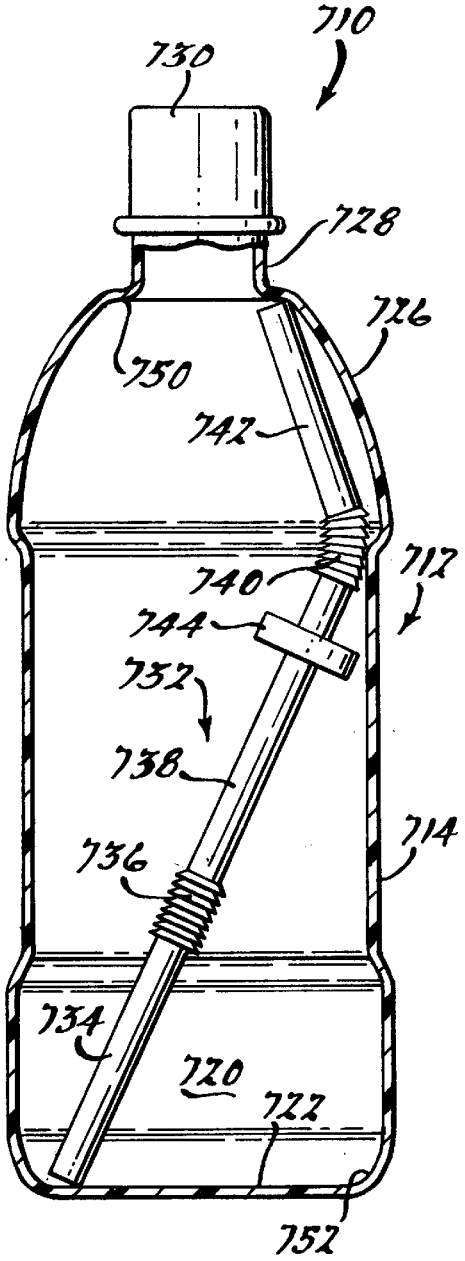
FIG. 15 is a side view of a bottle in accordance with another embodiment of the present invention.

Referring now to FIG. 15, a beverage container incorporating an internal straw in accordance with another embodiment of the present invention is illustrated and designated generally by the reference numeral 710. Beverage container 710 is a generally cylindrical container having a cylindrical wall 712 which defines a chamber 720. Container 710 can be manufactured from the various plastics mentioned above, it can be manufactured from glass, or it can be manufactured from other materials known in the art. While beverage container 710 is shown as a generally cylindrical container, it is to be understood that the present invention can be incorporated into either container shapes including but not limited to oval, rectangular or square.

Cylindrical wall 712 includes a lower cylindrical wall 714 which is closed by a bottom wall 722, an upper tapered wall 726 and a reduced diameter neck region 728. Container 710 is filled through neck region 728 and the fluid is subsequently dispensed through neck region 728. Neck region 728 is shown being closed and sealed by a threaded 730 but it is to be understood that neck region 728 can be closed and sealed by other means known in the art including but not limited to a snap closure or an induction bonded foil seal closure.

A straw 732 is disposed within chamber 720. Straw 732 comprises a lower tubular section 734, a lower pleated section 736, a middle tubular section 738, an upper pleated section 740, an upper tubular section 742 and a float 744. Lower pleated section 736 is an extension pleat which provides the ability for the straw to be extended in length for the convenience of the user. Upper pleated section 740 is a preload flex pleat whose function is to bend and be preloaded within chamber 720. Pleated section 740 provides an angle between lower tubular section 732 and upper tubular section 742 when the pleat is extended. This angle ensures the ability to load straw 732 into container 710. The preferred angle of unloaded pleated section 740 ranges between 20 and 35 degrees. The preferred angle of loaded pleated section 740 ranges between 35 and 50 degrees and more preferably between 40 and 46 degrees. Float 744 is attached to middle tubular section 738 and provides buoyancy for straw 732 to extend straw 732 through the open end of neck region 728 when cap 730 is removed.

The position of straw 732 in FIG. 15 is shown prior to and after container 710 is filled with fluid and sealed by cap 730. Neck region 728 and upper tapered wall 726 define a shoulder 750 which is equal to or slightly smaller than the diameter of straw 732. This size of shoulder 750 allows straw 732 to be inserted within chamber 720 and positioned such that it does not interfere with the filling of container 710. Lower tubular section 734 rests against a corner 752 of container 710 with upper pleated section 740 providing the preload to keep straw 732 in position.

Prior to filling, straw 732, in a generally straight condition, is inserted into chamber 720 through neck region 728 until the end of lower tubular section 734 contacts comer 752 and/or dimple 754. Initially, upper pleated section 740 is angled such that the end of lower tubular section 734 contacts bottom wall 722 and is deflected towards corner 752. When the end of lower tubular section 734 contacts corner 752, straw 732 bends or flexes at upper pleated section 740 and the upper end of upper tubular section 742 is snapped or wedged against shoulder 750 to retain straw 732 within chamber 720.

Once container 710 has been filled and cap 730 is secured to upper cylindrical wall 726, neck region 728 can be squeezed or manipulated by suitable means to release the upper end of upper tubular section 742 from shoulder 750 to position straw 732 similar to that shown in FIG. 1 for straw 32. If container 710 is manufactured from a rigid material such as glass, manipulation of the entire container 710 will be needed to release straw 732.

When cap 730 is removed, straw 732 will rise through neck region 728 due to the buoyancy of float 744, the spring action of upper pleated section 740 or both. This movement of straw 732 through neck region 728 positions straw 732 similar to that shown in FIG. 4 for straw 32.

While the above detailed description describes the preferred embodiment of the present invention, it should be understood that the present invention is susceptible to modification, variation and alteration without deviating from the scope and fair meaning of the subjoined claims.

What is claimed is:

1. A container comprising:

a body having a wall defining a chamber with a neck region, said wall defining an annular groove disposed adjacent said neck region;

a cap sealingly closing said chamber;

a straw having a top end and a bottom end, said straw being disposed within said chamber and movable between a first position where said straw is bent at a first angle and a second position where said straw is bent at a second angle, said second angle being greater than said first angle, said straw having an intermediate portion spaced from said ends, said intermediate portion being bent at said first angle producing a load to lodge said straw within said chamber by frictional engagement between said top end of said straw and said annular groove when said straw is in said first position, said straw being free of attachment when said straw is in said first position, said straw being totally disposed in said chamber and partially disposed within said neck region when in said second position.

2. The container according to claim 1, wherein said straw is movable between said first and second positions by manipulation of said container.

3. The container according to claim 2, wherein said straw includes a pleated section, said straw being bent at said pleated section when said straw is in said first position.

4. The container according to claim 1, wherein said straw includes a pleated section, said straw being bent at said pleated section when said straw is in said first position.

5. The container according to claim 1, further comprising a float attached to said straw.

6. The container according to claim 1, wherein said bottom end of said straw is disposed within a corner defined by said body when said straw is in said first position.

7. The container according to claim 6, wherein said straw includes a pleated section, said straw being bent at said pleated section when said straw is in said first position.

8. The container according to claim 1, wherein said body defines a conical section, said annular groove being disposed between said conical section and said neck.

9. A container comprising:

a body defining a chamber and having a neck region defining an opening for communicating with said chamber;

a cap sealingly closing said opening to seal said chamber;

a straw having a top end and a bottom end disposed within said sealed chamber and movable between a first position where said straw is bent at a first angle and a second position where said straw is bent at a second angle, said second angle being greater than said first angle, said straw having an intermediate portion spaced from said ends, said intermediate portion being bent at said first angle producing a load to lodge said straw within said sealed chamber by frictional engagement between said straw and said body when said straw is in said first position, said straw being free of attachment when said straw is in said first position, said straw being totally disposed and free to move within said sealed chamber with a portion of said straw disposed in said neck when said straw is in said second position.

10. The container according to claim 9 wherein said straw is movable between said first and second positions by manipulation of said container.

11. The container according to claim 10, wherein said straw includes a pleated section, said straw being bent at said pleated section when said straw is in said first position.

12. The container according to claim 9 wherein said container defines an annular step, said straw being trapped by said annular step when said straw is in said first position.

13. The container according to claim 9 wherein said straw includes a pleated section, said straw being bent at said pleated section.

14. The container according to claim 9, further comprising a float attached to said straw.

15. The container according to claim 9, wherein said bottom end of said straw is disposed within a corner defined by said body when said straw is in said first position.

16. The container according to claim 15, wherein said straw includes a pleated section, said straw being bent at said pleated section when said straw is in said first position.

17. The container according to claim 9, wherein said body defines a conical section, said annular groove being disposed between said conical section and said neck.

* * * * *